US005158294A

United States Patent [19]

Piro

[11] Patent Number: 5,158,294

[45] Date of Patent: Oct. 27, 1992

[54] LOTTERY CARD MARKING APPARATUS

[76] Inventor: Carmine Piro, 441 Minton Pl., Orange, N.J. 07050

[21] Appl. No.: 680,127

[22] Filed: May 28, 1991

[51] Int. Cl.[5] ..... A63F 3/06

[52] U.S. Cl. ..... 273/148 R; 283/49

[58] Field of Search ..... 273/148 A, 148 R, 269; 283/49, 903

[56] References Cited

U.S. PATENT DOCUMENTS 411,952 10/1889 Clay ..... 283/49

4,752,073 6/1988 Thompson ..... 273/148 R

FOREIGN PATENT DOCUMENTS 2814596 10/1979 Fed. Rep. of Germany ... 273/148 R 3407002 8/1985 Fed. Rep. of Germany ... 273/148 R

*Primary Examiner*—Benjamin H. Layno

*Attorney, Agent, or Firm*—Leon Gilden

[57] ABSTRACT

A lottery card marking apparatus provides a housing receiving a lottery card therewithin, with at least a top wall formed with a matrix of openings to coincide with free-positioned marking indicia on the lottery card. Optionally, the housing may include a rear wall with aligned apertures relative to the apertures to the forward wall to permit projection of a piercing instrument through the lottery card for marking purposes. Further, a modification includes a plurality of locking lug members slidably mounted to the right and left side edges of the housing to effect locking an alignment of the card within the housing during a marking procedure.

3 Claims, 4 Drawing Sheets

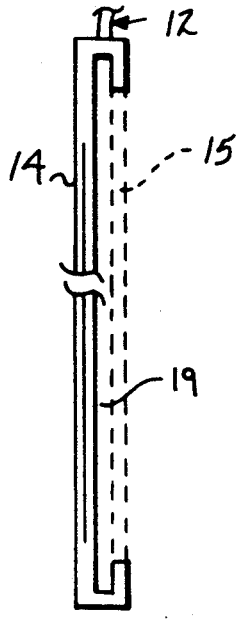
Fig 3
Fig 4
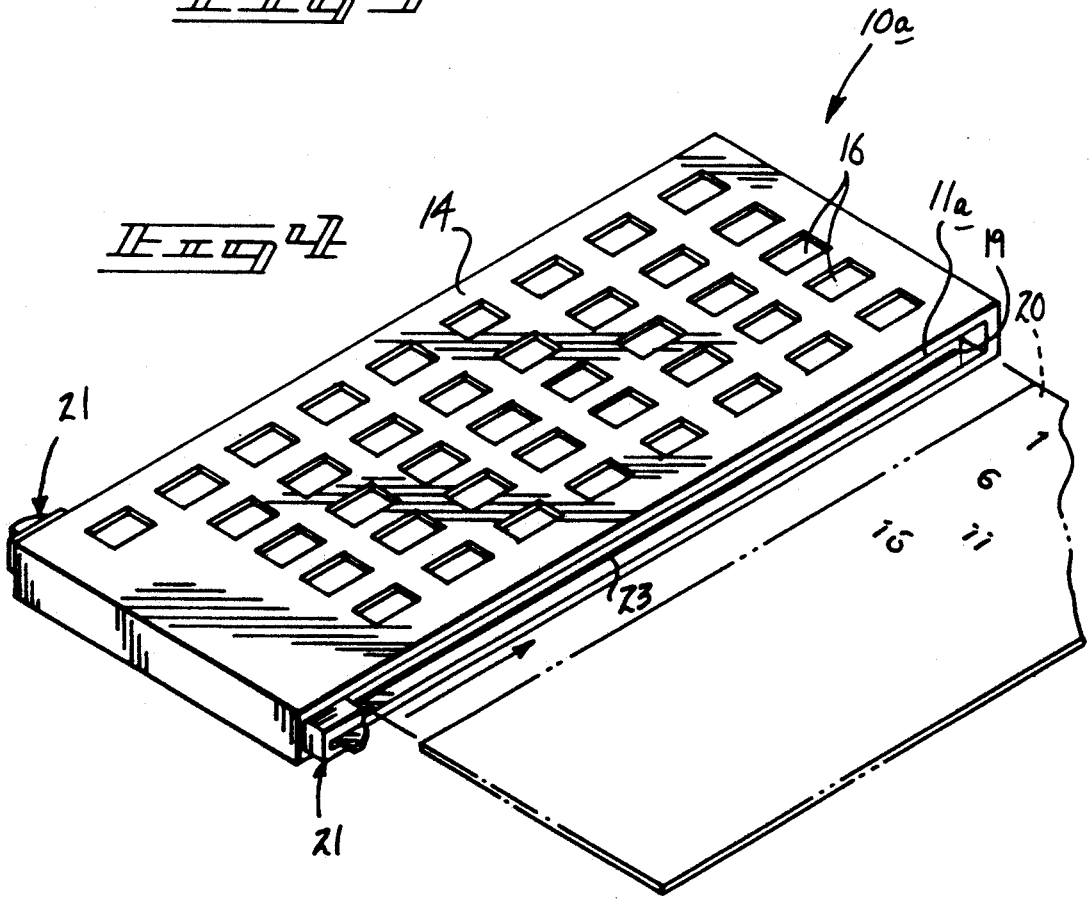

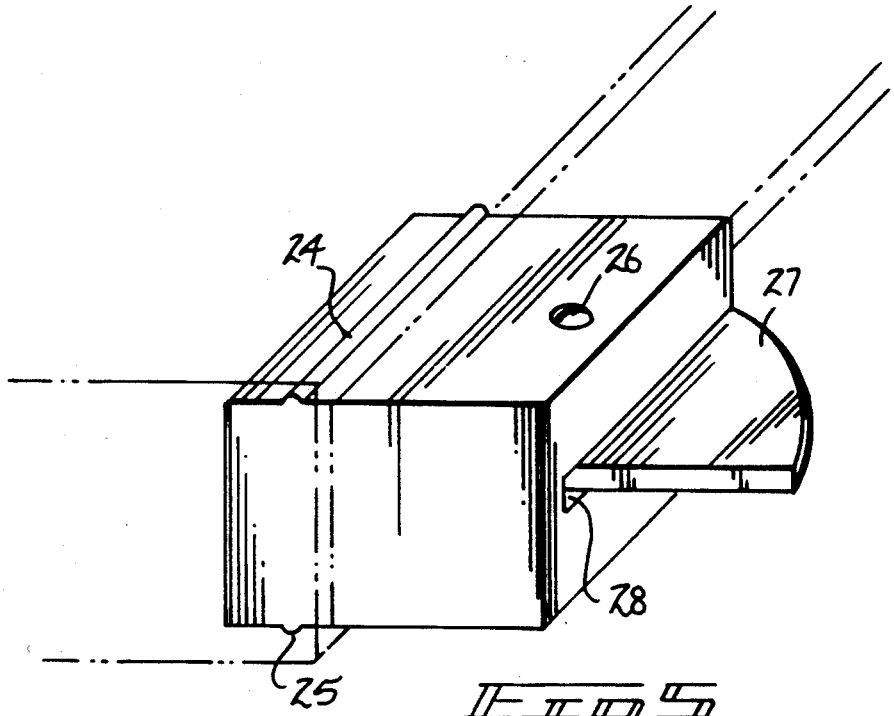
FIG 5
FIG 6
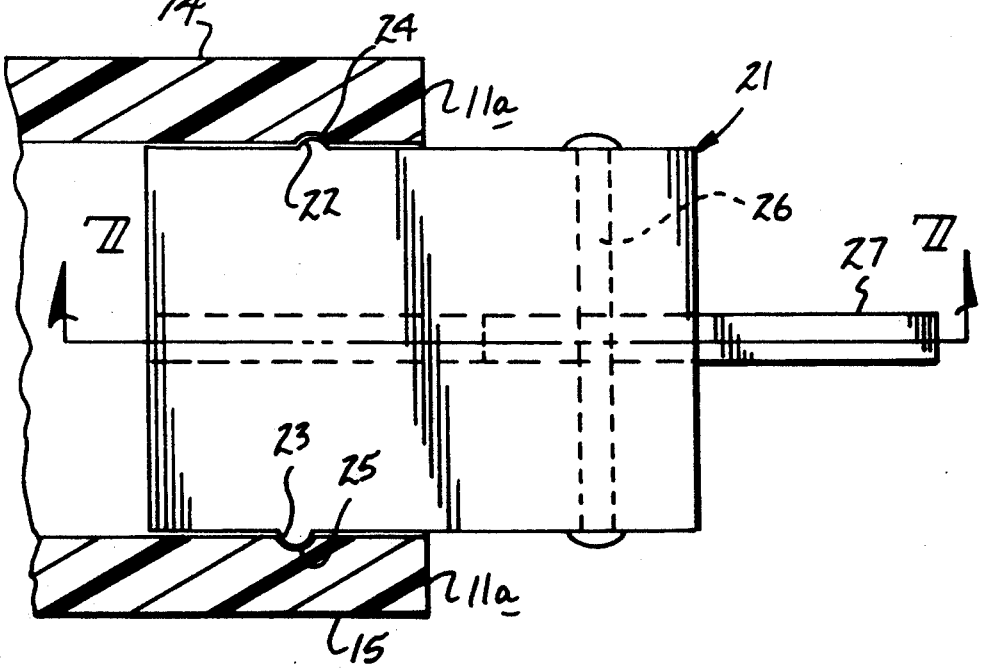

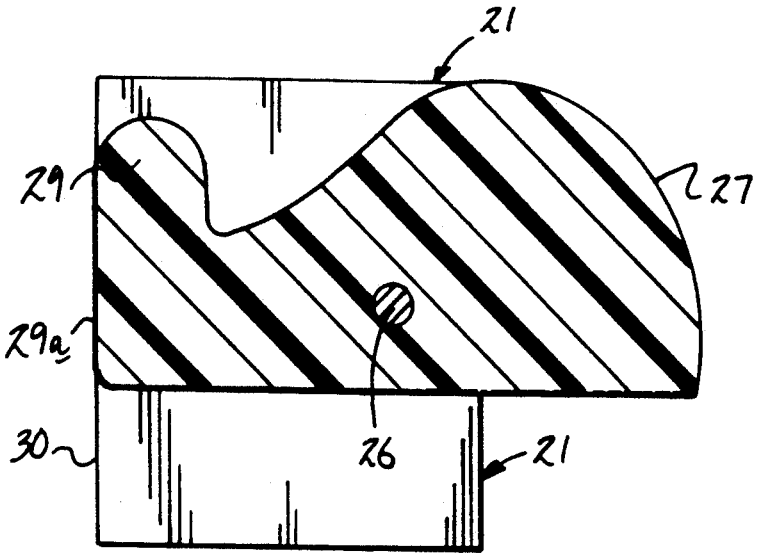
Fig 7
Fig 8
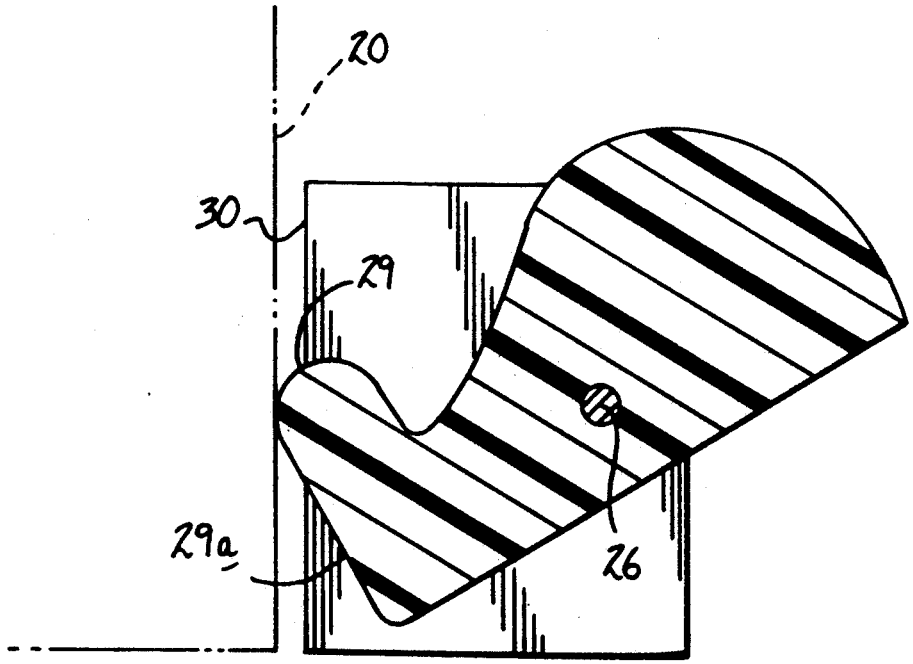

LOTTERY CARD MARKING APPARATUS

BACKGROUND OF THE INVENTION

1. Field of the Invention

The field of invention relates to lottery card apparatus, and more particularly pertains to a new and improved lottery card marking apparatus wherein the same is arranged for receiving and marking of lottery cards therewithin.

2. Description of the Prior Art

Lottery cards of various types are utilized, and a category of lottery cards is available requiring marking by patrons purchasing the cards. Lottery apparatus in the prior art has utilized various structure to effect generating or indicating of numbers relative to games of chance. For example, U.S. Pat. No. 4,688,797 to Sebestyen sets forth a number generating system wherein a movable panel includes openings that are aligned with various numbers underlying the panel to effect random generating of numbers for a game of chance, such as lottery.

U.S. Pat. No. 3,873,092 to Fagan sets forth a number generating device wherein an upper removable plate is positionable over underlying numbers to generate various random numbers thereby.

U.S. Pat. No. 3,003,767 to Keuls and U.S. Pat. No. 4,048,731 to Baguioro present game apparatus, wherein spheres are projected within openings within a board to generate random positioning of a sphere within an opening of an underlying board.

As such, it may be appreciated that there continues to be a need for a new and improved lottery card marking apparatus as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of lottery apparatus now present in the prior art, the present invention provides a lottery card marking apparatus wherein the same utilizes a housing to align and position a lottery card therewithin for marking of the card in a lottery type event. As such, the general purpose of the present invention, which will be described subsequently in greater detail, is to provide a new and improved lottery card marking apparatus which has all the advantages of the prior art lottery apparatus and none of the disadvantages.

To attain this, the present invention provides a lottery card marking apparatus with a housing receiving a lottery card therewithin, with at least a top wall formed with a matrix of openings to coincide with free-positioned marking indicia on the lottery card. Optionally, the housing may include a rear wall with aligned apertures relative to the apertures to the forward wall to permit projection of a piercing instrument through the lottery card for marking purposes. Further, a modification includes a plurality of locking lug members slidably mounted to the right and left side edges of the housing to effect locking and alignment of the card within the housing during a marking procedure.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved lottery card marking apparatus which has all the advantages of the prior art lottery apparatus and none of the disadvantages.

It is another object of the present invention to provide a new and improved lottery card marking apparatus which may be easily and efficiently manufactured and marketed.

It is a further object of the present invention to provide a new and improved lottery card marking apparatus which is of a durable and reliable construction.

An even further object of the present invention is to provide a new and improved lottery card marking apparatus which is susceptible of a low cost of manufacture with regard to both materials and labor, and which accordingly is then susceptible of low prices of sale to the consuming public, thereby making such lottery card marking apparatus economically available to the buying public.

Still yet another object of the present invention is to provide a new and improved lottery card marking apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is an orthographic side view of the instant invention.

FIG. 4 is an isometric illustration of a modified aspect of the instant invention.

FIG. 5 is an isometric illustration of locking lugs utilized by the invention, as set forth in FIG. 4.

FIG. 6 is an orthographic side view of the locking lug structure.

FIG. 7 is an orthographic view, taken along the lines 7—7 of FIG. 6 in the direction indicated by the arrows.

FIG. 8 is an orthographic view of the locking lug structure as set forth in FIG. 7 in a second locked position relative to an associated lottery card.

DESCRIPTION OF THE PREFERRED EMBODIMENT

Figure 1:
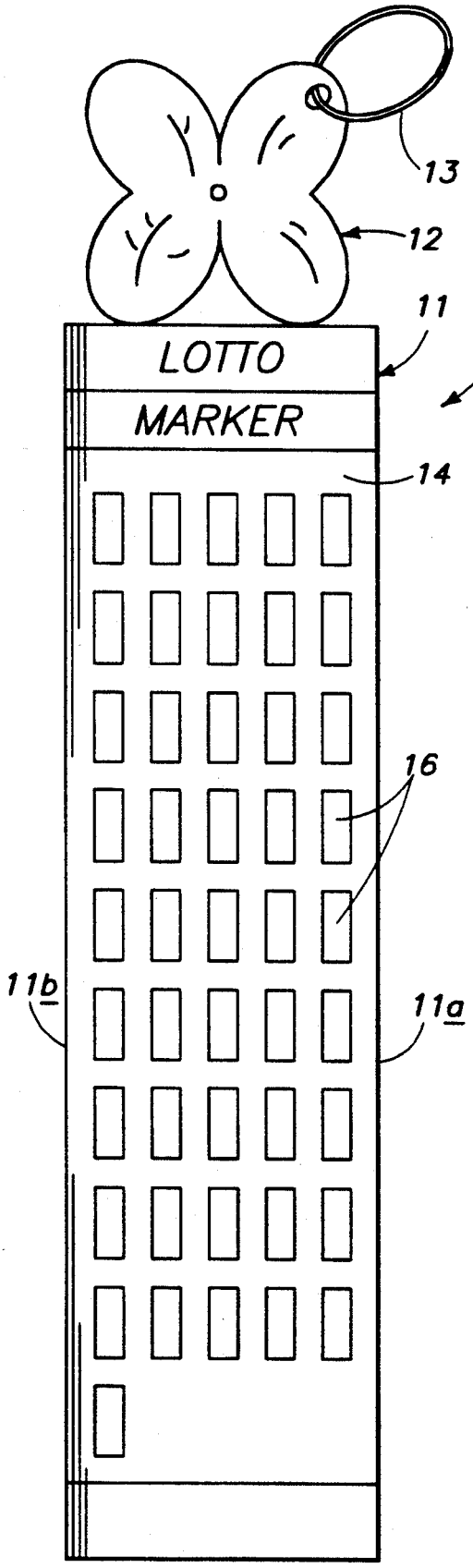
FIG. 1 is an orthographic top view of the instant invention.

With reference now to the drawings, and in particular to FIGS. 1 to 8 thereof, a new and improved lottery card marking apparatus embodying the principles and concepts of the present invention and generally designated by the reference numerals 10 and 10*a* will be described.

More specifically, the lottery card marking apparatus 10 of the instant invention essentially comprises a support housing 11, defined by right side edges 11*a* and left side edges 11*b* that further includes an extension plate 12 mounted to an upper terminal end of the support housing 11 mounting a ring member 13 thereon and permits transport and securement of the organization to a key chain and the like by an individual.

Figure 2:
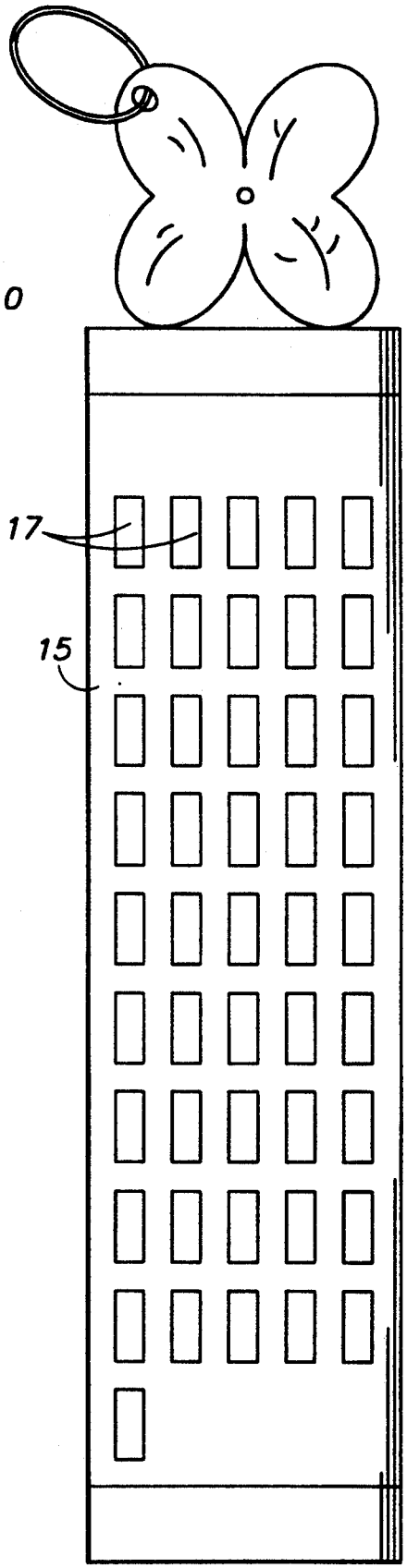
FIG. 2 is an orthographic rear view of the instant invention.

The housing 11 includes a forward housing wall 14 spaced from and parallel a rear housing wall 15, with a matrix of forward apertures 16 directed through the forward wall aligned with a matrix of rear apertures 17 directed through the rear wall. FIG. 3 illustrates that the rear wall may in fact be opened and merely provide "U" shaped slots to receive the card, but in the use of piercing of various discrete portions of a lottery card 20 when inserted in the housing, the forward and rear walls are utilized in cooperation relative to one another, as illustrated in FIGS. 1 and 2 for example, wherein a through-extending slot 19 defined by a predetermined width and a predetermined height is arranged to complimentarily receive the lottery card 20 therewithin.

FIG. 4 illustrates a modified lottery card marking apparatus 10*a* utilizing locking lug members 21 slidably mounted to the right and left sides 11*a* and 11*b* of the housing 11. The modified housing structure of FIG. 4 illustrates an upper groove 22 and a lower groove 23 formed within confronting interior surface of the forward and rear housing walls 14 and 15 adjacent each of the respective right and left side edges 11*a* and 11*b*. For purposes of illustration, the locking lug structures are identical, only the right side structure, as illustrated, and it is understood that the locking lug member 21 mounted to the left side 11*b* is of identical construction and operation.

A respective upper and lower lug projection 24 and 25 are slidably received within respective upper and lower grooves 22 and 23. The upper and lower lug projections 24 and 25 are projecting beyond a respective top and bottom surface of the locking lug member 21, wherein the top and bottom surfaces are arranged parallel relative to one another and defined by a predetermined height substantially equal to the predetermined width of the slot 19. The top and bottom surfaces 21 orthogonally receive an axle 26 therethrough, wherein the axle 26 pivotally mounts a locking cam plate 27 that is slidable within the cam plate slot 28 that is directed medially through the locking lug member 21 and orthogonally oriented relative to the axle 26. The cam plate 27 includes a cam foot 29, and includes a cam foot internal edge 29*a*, wherein the cam foot internal edge 29*a* is aligned with and overlying lug member interior side edge 30 in a first position, wherein the lug interior side edge 30 is arranged parallel to the respective right and left sides 11*a* and 11*b*. The cam foot 29 is accordingly pivotal to a second position to project the cam foot interior edge 29*a* interiorly of the slot 19 beyond the lug interior side edge 30 in contiguous communication with the lottery card 20 that is positioned within the cam slot 19, in a manner as illustrated in FIG. 8. It is understood that the lugs are utilized in cooperation with one another to positively secure and position the lottery card therebetween within the housing.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A lottery card marking apparatus comprising, a support housing, the support housing including a forward wall and a rear wall, the forward wall arranged parallel to and spaced from the rear wall to define a slot therebetween, and the forward including a matrix of forward wall apertures, and the rear wall including a matrix of rear apertures, wherein the rear apertures and forward apertures are aligned relative to one another to permit alignment of indicia on a lottery card receivable within the slot, wherein the housing includes a housing right side edge and a housing left side edge, wherein the housing right side edge and left side edge are arranged parallel relative to one another, and wherein the housing right side edge and left side edge each receive the slot therethrough and a locking lug member slidably mounted to the right side edge and to the left side edge and the locking lug member including a planar locking lug top wall and a planar locking lug bottom wall, wherein the slot is defined by a predetermined width and each of said locking lug members is defined by a predetermined height wherein the predetermined height is equal to the predetermined width of the slot, and the forward housing wall and the rear housing wall each include a groove adjacent the right side edge and left side edge of the housing and each locking lug member includes a top projection and a bottom projection projecting beyond each locking lug top wall and locking lug bottom wall wherein each projection is received within a respective groove of the top wall and bottom wall to slidingly align each locking lug member within the housing, and an extension plate mounted to the housing oriented parallel to the forward wall and rear wall and extending beyond the forward and rear walls, and includes a ring member to permit transport of the housing.

2. An apparatus as set forth in claim 1 wherein each locking lug member includes an axle orthogonally directed through the locking lug top wall and locking lug bottom wall, and each locking member including a cam plate slot directed medially through each of said locking lug members orthogonally oriented relative to the axle, and each slot slidably receives a locking cam plate therewithin, wherein the locking cam plate is mounted pivotally about the axle of each locking lug member.

3. An apparatus as set forth in claim 2 wherein each locking lug member includes a lug interior side edge oriented orthogonally relative to the locking lug top wall and the locking lug bottom wall, and wherein the locking cam plate includes a cam foot, the cam foot is pivotal from a first position to a second position, and the cam foot includes an interior edge, wherein the interior edge of the cam foot is aligned with and overlying the locking lug interior side edge in the first position, and wherein the cam foot interior edge at least partially projects beyond the lug interior side edge in the second position to secure the lottery card between each cam foot of each cam plate.

* * * * *